US007518510B2

(12) United States Patent
Kojo

(10) Patent No.: US 7,518,510 B2
(45) Date of Patent: Apr. 14, 2009

(54) INFORMATION PROCESSING APPARATUS AND ANTITHEFT METHOD FOR THE APPARATUS

(75) Inventor: Akihiro Kojo, Tokyo (JP)

(73) Assignee: Kabuhsiki Kaisha Toshiba, Tokyo (JP)

( * ) Notice: Subject to any disclaimer, the term of this patent is extended or adjusted under 35 U.S.C. 154(b) by 278 days.

(21) Appl. No.: 11/509,679

(22) Filed: Aug. 25, 2006

(65) Prior Publication Data

US 2007/0040678 A1 Feb. 22, 2007

Related U.S. Application Data

(63) Continuation of application No. PCT/JP2005/003233, filed on Feb. 21, 2005.

(30) Foreign Application Priority Data

Feb. 25, 2004 (JP) ..... 2004-050307

(51) Int. Cl.
*G08B 13/14* (2006.01)

(52) U.S. Cl. ..... 340/568.1; 340/539.1; 340/541; 340/571; 340/573.1; 340/825.69; 340/825.72

(58) Field of Classification Search ..... 340/568.1, 340/539.1, 539.13, 539.23, 541, 571, 573.1, 340/686.1, 825.69, 825.72, 328; 235/380, 235/381, 383
See application file for complete search history.

(56) References Cited

U.S. PATENT DOCUMENTS 5,406,261 A * 4/1995 Glenn ..... 340/571
5,872,515 A * 2/1999 Ha et al. ..... 340/571
6,014,079 A * 1/2000 Huang ..... 340/571
6,037,748 A * 3/2000 Yee et al. ..... 320/127
6,970,095 B1 * 11/2005 Lee et al. ..... 340/669
2002/0121976 A1 * 9/2002 Huang ..... 340/571
2004/0155777 A1 * 8/2004 Mitchell et al. ..... 340/568.1

FOREIGN PATENT DOCUMENTS

JP 59-008095 A 1/1984
JP 59-8095 A 1/1984
JP 05-035355 A 2/1993
JP 09-198576 A 7/1997
JP 2000-099186 A 4/2000
JP 2000-155876 A 6/2000
JP 2000-172960 A 6/2000
JP 2000-215374 A 8/2000
JP 2002-99347 A 4/2002
JP 2002-37338 A 12/2002
JP 2002-373386 A 12/2002
JP 2003-112606 A 4/2003

* cited by examiner

*Primary Examiner*—Hung T. Nguyen
(74) *Attorney, Agent, or Firm*—Pillsbury Winthrop Shaw Pittman, LLP

(57) ABSTRACT

An information processing apparatus includes a main body; an input unit for inputting information; an information processor for processing the information input with the input unit; a movement detecting sensor, provided in the main body, for detecting a movement of the main body; a power-supply controller for turning on a main power supply in the main body based on a movement detection signal supplied from the movement detecting sensor; and an alarm generator for generating an alarm when the main power supply is turned on based on the movement detection signal.

14 Claims, 10 Drawing Sheets

INFORMATION PROCESSING APPARATUS AND ANTITHEFT METHOD FOR THE APPARATUS

CROSS-REFERENCE TO RELATED APPLICATION

This application is a continuation of PCT Application No. PCT/JP2005/003233 filed Feb. 21, 2005, which relies for priority on Japanese Patent Application No. 2004-050307, filed Feb. 25, 2004, the entire contents of both of which are incorporated herein by reference.

BACKGROUND

1. Field

The present invention relates to an information processing apparatus having an antitheft function and an antitheft method for the information processing apparatus.

2. Description of the Related Art

Rapid progress in technologies of reduction in size and weight saving for information processing apparatuses has been notable in recent years. Particularly, in a personal computer field, portable and highly functional notebook personal computers with higher performance have been in widespread use. Notebook personal computers are generally used not only during business trips or outside offices but also in offices or at home, in place of conventional stationary desktop personal computers.

Since compact information processing apparatuses typified by the notebook personal computers can easily be carried, various antitheft measures have been devised.

For example, Japanese Patent Application Publication (KOKAI) No. 9-198576 discloses a compact antitheft device mountable in an information processing apparatus. Such a compact antitheft device includes a vibration sensor to determine whether the information processing apparatus is carried based on a vibration period or the like. If it is determined that the information processing apparatus is carried, an alarm sound is generated by a built-in speaker. The alarm sound continues to be generated unless authentication by using a password known only to a legal owner succeeds.

Japanese Patent Application Publication (KOKAI) No. 2000-155876 discloses an information processing apparatus having an antitheft function. The information processing apparatus determines whether it is carried based on information in a distance sensor, an illumination sensor, or a gyrosensor included in the information processing apparatus. If the information processing apparatus determines that it is not carried, the need for power-on password authentication or password authentication for decoding is eliminated, thus increasing the usability of a user.

If the information processing apparatus determines that it is carried, the information processing apparatus not only generates an alarm, but also requests the carrier to perform the power-on password authentication or the password authentication for decoding. If the authentication fails, the information processing apparatus stops a startup sequence to prevent the carrier from using the information processing apparatus.

Japanese Patent Application Publication (KOKAI) No. 2002-99347 discloses an information processing apparatus having an antitheft function, which can be realized in lower power consumption and at a lower cost. The information processing apparatus detects that it is carried by using a switch provided on the bottom of the information processing apparatus to generate an alarm by a sound source dedicated to alarm generation. A legal owner can stop the alarm by inputting an alarm-clear password.

When the information processing apparatus is separated from the antitheft device (for example, Japanese Patent Application Publication (KOKAI) No. 9-198576), the antitheft device can advantageously be mounted in various information processing apparatuses.

However, in order to prevent an illegal carrier from easily detaching the antitheft device, the antitheft device must be mounted in the information processing apparatus and, therefore, it is not easy to mount the antitheft device. In addition, it is hard to access the antitheft device mounted in the information processing apparatus when a legal owner is to input a password for clearing the alarm.

In contrast, in Patent Documents 2 and 3, the antitheft function is incorporated in the information processing apparatus.

Generally, the antitheft function for the information processing apparatus is required when a legal owner is absent and the main power supply of the information processing apparatus is turned off. In many information processing apparatuses, a function for determining whether a main-power-supply switch is turned on or a clock function is enabled even when the main power supply is turned off. However, the power consumption in these functions is low, and the power supply system with the main power supply being turned off is often structured on the assumption of the low power consumption. Hence, the information processing apparatus having the antitheft function realized in low power consumption is required even when the antitheft function is incorporated in the information processing apparatus.

The invention disclosed in the Japanese Patent Application Publication (KOKAI) No. 2000-155876 is disadvantageous in the power consumption, whereas the antitheft function realized in low power consumption is disclosed in Japanese Patent Application Publication (KOKAI) No. 2002-99347.

However, in known inventions already disclosed, the functions of the information processing apparatuses are separated from the antitheft function even when the antitheft function is incorporated in the information processing apparatuses. Accordingly, a method of clearing an alarm by inputting an alarm-clear password when a legal owner erroneously generates the alarm is different from a method of inputting the power-on password for activating the information processing apparatus. Such information processing apparatuses are inconvenient to the legal owner in usability.

In addition, since the functions of the information processing apparatuses are separated from the antitheft function, only the antitheft function is enabled when the information processing apparatuses are carried. Specifically, only limited antitheft means, such as an alarm sound, can be adopted.

It is anticipated that, in order to stop any generated alarm, an illegal carrier turns off the power supply switch, removes the battery, or lowers the sound volume of the alarm. Satisfactory countermeasures against such actions have not been disclosed yet.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

An information processing apparatus and an antitheft method for the information processing apparatus according to a first embodiment of the present invention will be described with reference to the attached drawings.

Figure 1:
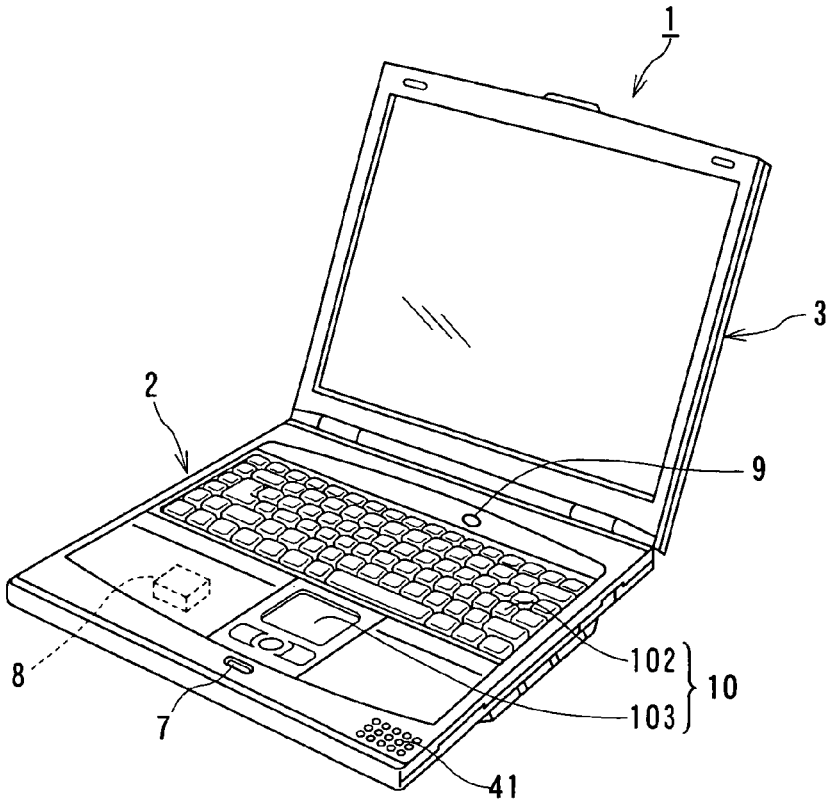
FIG. 1 is an outside view of an information processing apparatus according to a first embodiment of the present invention.

FIG. 1 is an outside view of the information processing apparatus according to the first embodiment of the present invention. Referring to FIG. 1, an information processing apparatus 1 has an information processor 2 and a main display 3.

The information processing apparatus (main body) 1 also has an acceleration sensor 8 serving as a movement detecting sensor for detecting a movement of the information processing apparatus 1. The information processing apparatus 1 further has a built-in speaker 41 serving as means for generating an alarm when a movement of the information processing apparatus 1 is detected.

The information processor 2 has an input unit 10 provided thereon. The input unit 10 includes a keyboard 102 and a pointing device 103. A variety of data is input by using the input unit 10.

The information processor 2 also has a main-power-supply switch 7 and an auxiliary display 9 provided thereon. The main-power-supply switch 7 activates the information processing apparatus 1.

The information processing apparatus 1 shown in FIG. 1 may have various shapes and sizes. The components of the information processing apparatus 1 may have various shapes and sizes and may be arranged at various positions. The information processing apparatus 1 may be structured so as to include part of the components shown in FIG. 1.

Figure 2:
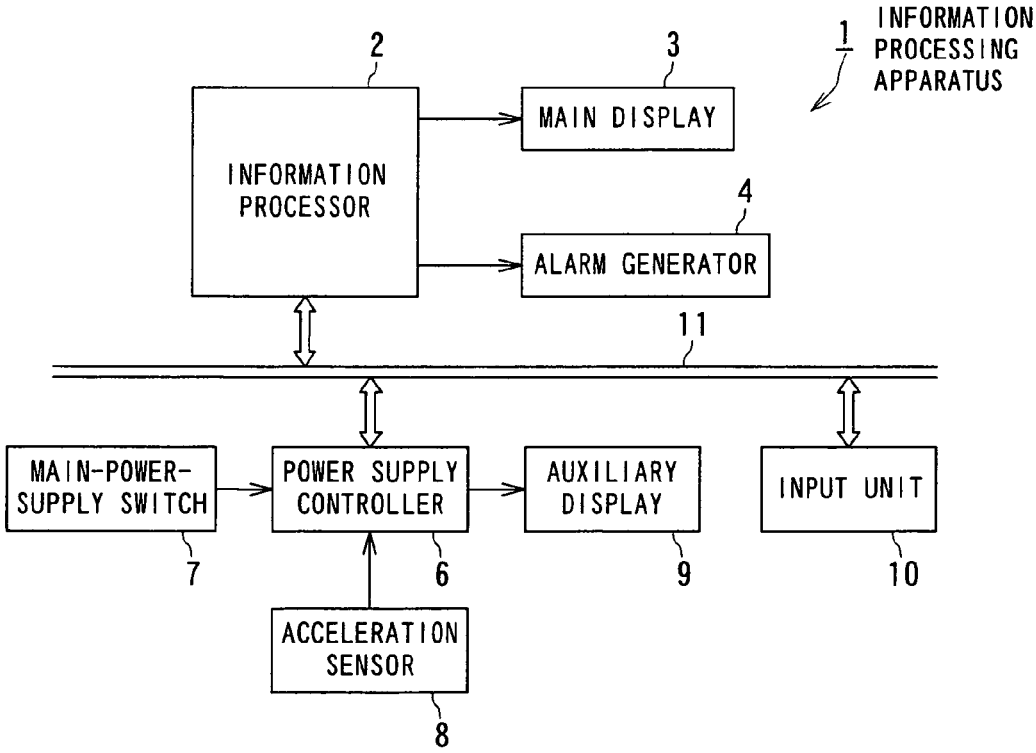
FIG. 2 is a schematic flow diagram of the information processing apparatus of the first embodiment.

FIG. 2 is a schematic flow diagram of the information processing apparatus 1 of the present invention. A basic structure of the information processing apparatus 1 will now be described with reference to FIG. 2.

In the information processing apparatus 1, the information processor 2, the input unit 10, and a power-supply controller 6 are connected to each other via a bus 11. The information processor 2 is connected to the main display 3 for displaying a variety of information and to an alarm generator 4 for generating an alarm. The power-supply controller 6 is connected to the main-power-supply switch 7, the acceleration sensor 8, and the auxiliary display 9.

The information processing apparatus 1 may be realized in various embodiments. A typical embodiment of the information processing apparatus 1 is a notebook personal computer. In the notebook personal computer, the input unit 10 generally includes the keyboard 102 and the pointing device 103. The main display 3 is a liquid crystal display (LCD) or the like.

The information processing apparatus 1 can perform various information processing functions, such as document preparation, execution of spreadsheet program, and information collection or data retrieval over the Internet. These functions, which are inherent in the information processing apparatus 1, are hereinafter referred to as basic information processing functions.

The information processing apparatus 1 of the present invention has an antitheft function for the information processing apparatus 1, in addition to the basic information processing functions.

The document preparation is taken as an example to explain the basic information processing functions of the information processing apparatus 1. The summary of the operation of the information processing apparatus 1 from a startup sequence to a termination sequence will now be described.

The power-supply controller 6 in the information processing apparatus 1 is always in an operational state even in a power-off state owing to the power supplied from an internal battery or the power externally supplied through an alternating current (AC) adapter. Power is also supplied to the auxiliary display 9 in the power-off state and, therefore, a user can visually confirm the state of charge in the battery or whether the power is externally provided. The power consumption in the power-supply controller 6 or the auxiliary display 9 is substantially lower than that in a power-on state.

Depressing, for example, the main-power-supply switch 7 by the user activates the information processing apparatus 1. The power-supply controller 6 recognizes the depression of the main-power-supply switch 7 and turns on a main power supply. In other words, the power from the battery or the power supplied through the AC adapter is supplied to each component, such as the information processor 2 or the alarm generator 4, and to each part in the main display 3. This state is called the power-on state.

Next, the information processor 2 sequentially starts up the control program in an input-output device called a basic input/output system (BIOS) and basic software called an operating system (OS).

In order to authenticate the user as a legal owner of the information processing apparatus 1, the information processor 2 performs authentication process by using a power-on password. In other words, the information processor 2 determines whether a power-on password input by the user with the input unit 10 in accordance with the display in the main display 3 coincides with a power-on password that has been registered in advance in the information processor 2 by the legal owner. If the power-on password input by the user coincides with the registered power-on password, that is, only if the authentication succeeds, the information processor 2 follows the startup sequence.

The authentication process may be performed by using an authentication material having the function of a compact and portable key that is held only by the legal owner and that is called a token, in addition to the authentication by using the password. The token for authentication may be a universal serial bus (USB) key detachable from a USB connector provided in the information processing apparatus 1, an integrated circuit (IC) card, or a memory card.

The legal owner performs the authentication by inserting the token into the information processing apparatus 1. The legal owner is authenticated based on the determination that the data stored in the token coincides with the data stored in the information processing apparatus 1.

Ordinarily, the necessity of the authentication process can be registered in advance in the information processing apparatus 1 by the legal owner.

If the authentication by using, for example, the power-on password succeeds, the user (legal owner) can activate an application program, such as a document preparation program, under the control of the OS.

Since the termination sequence of the information processing apparatus 1 is usually performed under the control of the OS, there is no need to depress the main-power-supply switch 7. Terminating the OS automatically causes the power-off state.

The basic information processing functions are schematically performed in the manner described above. When the information processing apparatus 1 is a desktop apparatus and cannot be carried, the authentication process can prevent an illegal user from using the information processing apparatus 1.

However, when the information processing apparatus 1 is a portable apparatus, an illegal carriage or theft cannot be prevented only by performing the authentication process. Accordingly, the antitheft function is particularly required for the portable information processing apparatus 1.

The basic flow of the antitheft function for the information processing apparatus 1 will now be described with reference to the schematic flow diagram shown in FIG. 2.

As shown in FIG. 2, the acceleration sensor 8 is connected to the power-supply controller 6 and is fixed in the information processing apparatus 1. When the information processing apparatus 1 is moved, for example, the information processing apparatus 1 is carried, the acceleration sensor 8 detects the acceleration occurring with the movement. The detected acceleration signal is a movement detection signal. The acceleration sensor 8 serves as a movement detecting sensor. The movement detecting sensor may be, for example, a gyro-sensor or a global positioning system (GPS).

The acceleration sensor 8 is electrified even in the power-off state, like the power-supply controller 6. Hence, the acceleration sensor 8 can detect a movement of the information processing apparatus 1 even when the information processing apparatus 1 is in the power-off state and can transmit the movement detection signal to the power-supply controller 6.

The power-supply controller 6 determines whether the movement is detected based on the movement detection signal transmitted from the acceleration sensor 8. After detecting the movement, the power-supply controller 6 automatically turns on the main power supply to automatically start the startup sequence.

When the information processing apparatus 1 that is in the power-off state is carried, the information processing apparatus 1 automatically switches to the power-on state. In the power-on state, the power is supplied to all the components, including the information processor 2, the alarm generator 4, and the main display 3, of the information processing apparatus 1. Accordingly, it is possible to fulfill the effective antitheft function against an illegal carrier by sufficiently utilizing various functions inherent in the information processing apparatus 1. Concurrently, it is possible to disable the antitheft function for a legal owner with a simple operation.

Figure 3:
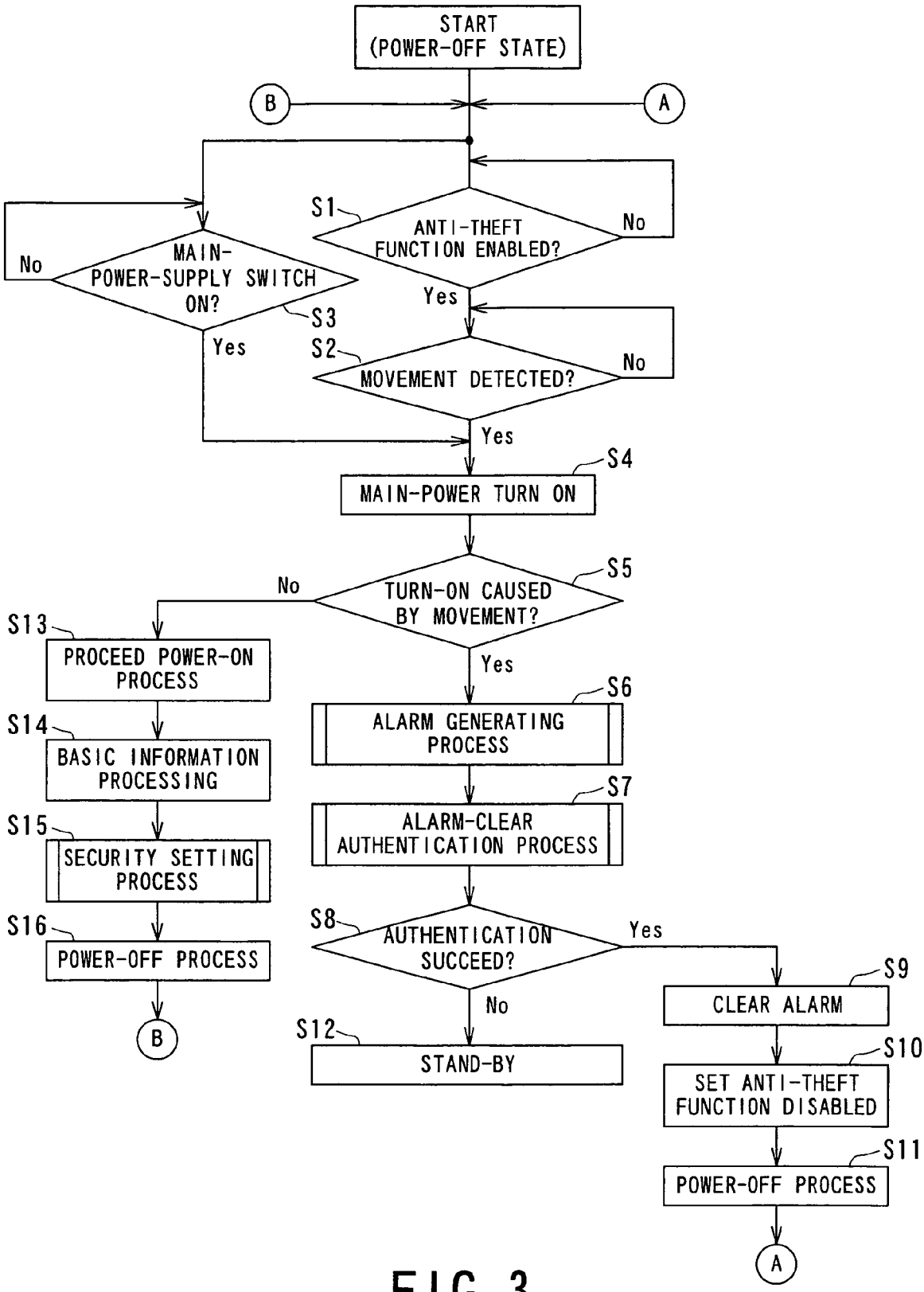
FIG. 3 is a flowchart showing the basic process of the information processing apparatus of the first embodiment.

FIG. 3 is a flowchart showing the basic process of the information processing apparatus 1. The basic process flow of the information processing apparatus 1 will now be described with reference to FIG. 3.

The information processing apparatus 1 is in the power-off state as an initial state. The power-supply controller 6 in the information processing apparatus 1 is electrified even in the power-off state. In Step S1, the power-supply controller 6 determines whether the antitheft function is set to "enabled".

The antitheft function is set, in advance, to "enabled" or "disabled" by the legal owner in the power-on state. The setting of the antitheft function is stored in, for example, a nonvolatile memory in the power-supply controller 6.

If the antitheft function is set to "disabled", the power-supply controller 6 is in the power-off state and is on standby. In this case, regardless of a legal owner or an illegal user, when the main-power-supply switch 7 on the information processing apparatus 1 is depressed in Step S3, then in Step S4, the power-supply controller 6 recognizes the depression of the main-power-supply switch 7 and turns on the main power supply. The main power supply that is turned on supplies power to the information processor 2 and so on in the information processing apparatus 1 to start the startup sequence.

If the antitheft function is set to "enabled" in Step S1, then in Step S2, the power-supply controller 6 in the information processing apparatus 1 always monitors a signal supplied from the acceleration sensor 8.

When the information processing apparatus 1 is moved, the acceleration sensor 8 detects an acceleration occurring due to the movement and supplies an acceleration detection signal to the power-supply controller 6. The power-supply controller 6 determines whether the movement is detected based on the acceleration detection signal. If the power-supply controller 6 determines in Step S2 that the movement is detected, then in Step S4, the power-supply controller 6 automatically turns on the main power supply and power is supplied to the information processor 2 and so on.

The power-supply controller 6 has information concerning whether the turning on of the main power supply is caused by the detection of the movement or by the depression of the main-power-supply switch 7.

In Step S5, the information processor 2 receives this information from the power-supply controller 6 via the bus 11 to determine the cause of the turning on of the main power supply.

As described above, the power-supply controller 6 and the information processor 2 constitute means for determining the cause of the turning on of the main power supply.

If the information processor 2 determines in Step S5 that the turning on of the main power supply is caused by the detection of the movement, in Step S6, the information processor 2 performs an alarm generating process. The alarm generating process can be performed in various modes. For example, alarm generating means mainly including the built-in speaker 41 in the information processing apparatus 1 can be used to generate an alarm.

In Step S7, the information processor 2 performs an alarm-clear authentication process. The alarm-clear authentication process can be performed in various modes. Adopting the same method as in the authentication in the power-on state of the basic information processing functions can relieve the burden on the legal owner. For example, when the power-on password is used in the power-on authentication method of the basic information processing functions, the same password as the power-on password is used as the alarm-clear password. Concurrently, the same screen for requesting the input of the password is displayed in the main display 3 of the information processing apparatus 1, thereby relieving the burden on the legal owner.

Particularly, when an alarm is generated as a result of an erroneous movement of the information processing apparatus 1 by the legal owner, it is desirable that the alarm can be cleared in a short time. The legal owner daily uses the power-on password. Hence, if the alarm-clear password is the same as the power-on password and the alarm-clear password is input in the same manner as in the power-on password, the legal owner can clear the alarm in a short time because he/she is familiar with the method.

Such an alarm-clear method can be adopted because the main power supply is automatically turned on after the movement is detected and the information processor 2 in the information processing apparatus 1 is in the power-on state, like the basic information processing functions.

If the password registered in advance by the legal owner coincides with the password input in the authentication process in Step S7, that is, if the authentication succeeds in Step S8, then in Step S9, the information processor 2 clears the alarm. Then, in order to avoid generating an alarm again due to a movement by the legal owner, in Step S10, the information processor 2 automatically sets the antitheft function to "disabled". In Step S11, the information processor 2 automatically performs a power-off process to be in the power-off state.

If the authentication fails in Step S8, then in Step S12, the information processor 2 assumes that the information processing apparatus 1 is moved by an illegal carrier and is on standby while continuing to generate the alarm. The information processor 2 continues to generate the alarm until the battery is dead, unless the authentication succeeds. Accordingly, the illegal carrier gives up the carriage of the information processing apparatus 1, thereby preventing the theft.

If the information processor 2 determines in Step S5 that the turning on of the main power supply is caused by the depression of the main-power-supply switch 7, instead of the detection of the movement, then in Steps S13 and S14, the information processor 2 performs a power-on process and the basic information processing functions.

In Step S15, the legal owner performs a security setting process in the power-on state. The security setting process includes processes for setting the antitheft function to "enabled" or "disabled", registering the power-on password, and changing the power-on password.

In Step S16, the power-off process is performed to switch the information processing apparatus 1 to the power-off state. However, the security setting is stored even in the power-off state.

Figure 4:
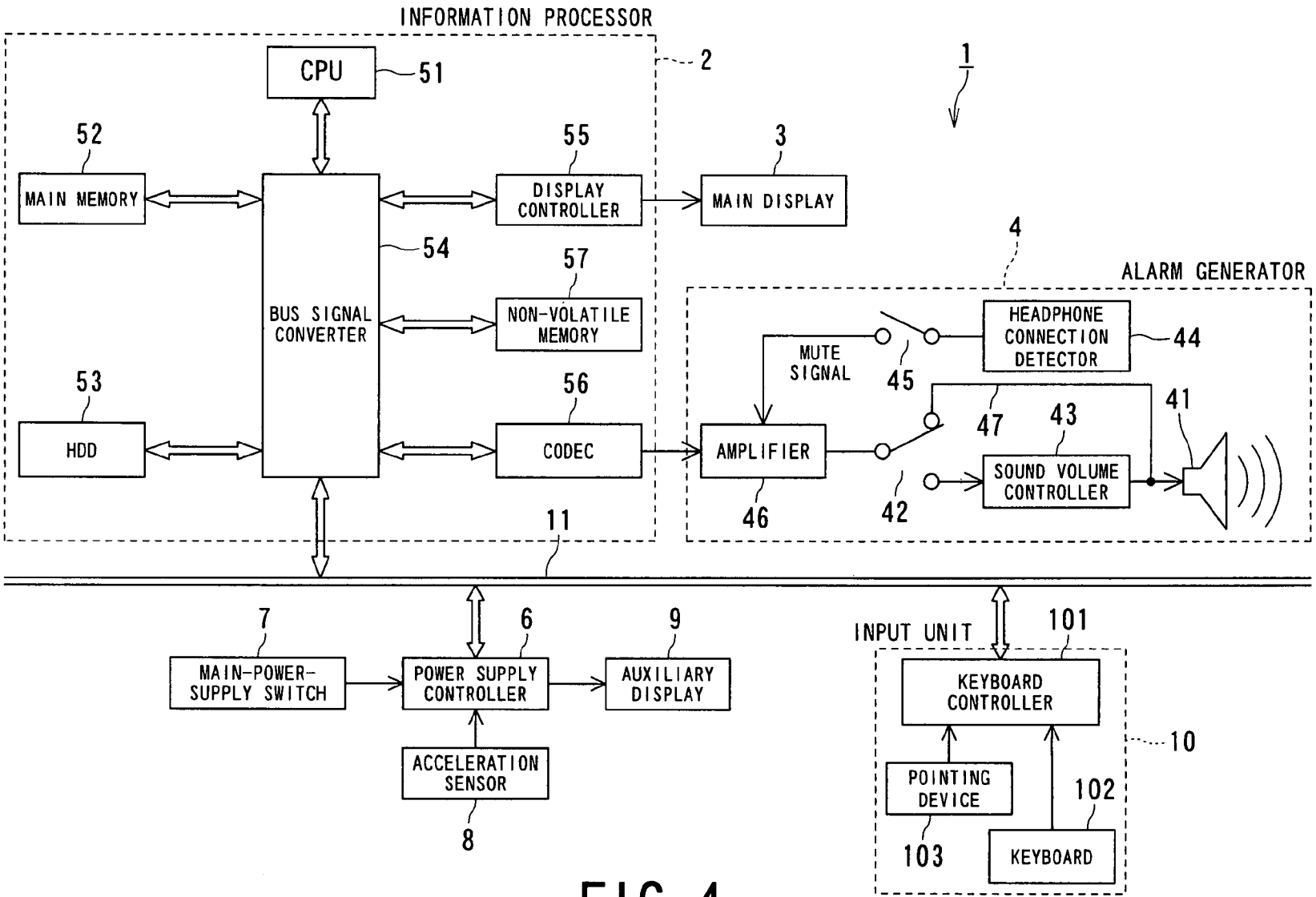
FIG. 4 is a block diagram showing a detailed structure of the information processing apparatus of the first embodiment.

FIG. 4 is a block diagram showing a detailed structure of the information processing apparatus 1 according to the first embodiment. The same reference numerals are used in FIG. 4 to identify the same components in the schematic flow diagram shown in FIG. 2. The following description focuses on components not shown in FIG. 2.

The information processing apparatus 1 has a structure in which the information processor 2, the power-supply controller 6, and the input unit 10 are connected to each other via the bus 11.

In the information processor 2, a central processing unit (CPU) 51 is connected to a main memory 52, a hard disk drive (HDD) 53, a display controller 55, a coder-decoder (CODEC) 56, and a nonvolatile memory 57 via a bus signal converter 54. The bus signal converter 54 converts signals transmitted and/or received to and/from the above components into ones appropriate for the components.

The CPU 51 reads out BIOS data stored in the nonvolatile memory 57, OS data stored in the HDD 53, or an application program such as a document preparation program, and executes the program while exchanging the data or program with the main memory 52.

The display controller 5 controls the main display 3 of the information processing apparatus 1 to display data or images on the main display 3.

The CODEC 56 controls a sound-volume control function or a mute function (sound deadening function) of an analog voice circuit, in addition to a function of coding or decoding signals or data in accordance with a predetermined rule and an analog-to-digital (A/D) or digital-to-analog (D/A) converting function.

The alarm generator 4 includes an amplifier 46 for amplifying the signal supplied from the CODEC 56, a sound-volume controller 43 for controlling the sound volume of the amplified signal, a bypass circuit 47 in use for bypassing the sound-volume controller 43, the built-in speaker 41 for generating a sound, a volume-control-function disabling switch 42 for switching between the sound-volume controller 43 and the bypass circuit 47, a headphone connection detector 44 for detecting a headphone or the like that is connected to the information processing apparatus 1, a mute-function disabling switch 45, and so on.

An analog signal (for example, an alarm sound) from the CODEC 56 in the information processor 2 is supplied to the amplifier 46. The analog signal amplified by the amplifier 46 is supplied to the sound-volume controller 43 through the volume-control-function disabling switch 42. The sound-volume controller 43 controls the sound volume of the built-in speaker 41 based on a user operation of a sound-volume control dial or the like provided, for example, outside the side face of the information processing apparatus 1.

The volume-control-function disabling switch 42 serves as means for disabling the sound-volume control function.

When the volume-control-function disabling switch 42 is switched to the side of the bypass circuit 47 under the control of the information processor 2, the sound-volume control function is disabled. In this state, the built-in speaker 41 has a sound volume set in the information processor 2 even when the user controls the sound-volume control dial on the sound-volume controller 43.

The headphone connection detector 44 detects connection of a headphone or a microphone to a connector provided outside the side face of the information processing apparatus 1 and transmits a mute signal (a signal for reducing the gain of the amplifier 46) to the amplifier 46. The sound from the built-in speaker 41 is muted by the mute signal. Hence, for example, when the user connects the headphone to the information processing apparatus 1, the sound from the built-in speaker 41 is muted and, therefore, the user hears only the sound from the headphone.

The mute-function disabling switch 45 is means for disabling the mute function. When the mute-function disabling switch 45 is switched to off under the control of the information processor 2, the mute signal is not supplied. As a result, even when the headphone or the microphone is connected to the information processing apparatus 1, the sound from the built-in speaker 41 is not muted.

The input unit 10 includes the keyboard 102 and the pointing device 103.

The pointing device 103, which is, for example, a mouse or a touch pad, indicates the position of a cursor on the screen of the main display 3 of the information processing apparatus 1.

Detailed operations of the information processor 2, the alarm generator 4, and the input unit 10 relating to an alarm generating function will now be described with reference to flowcharts shown in FIGS. 5 to 7.

Figure 5:
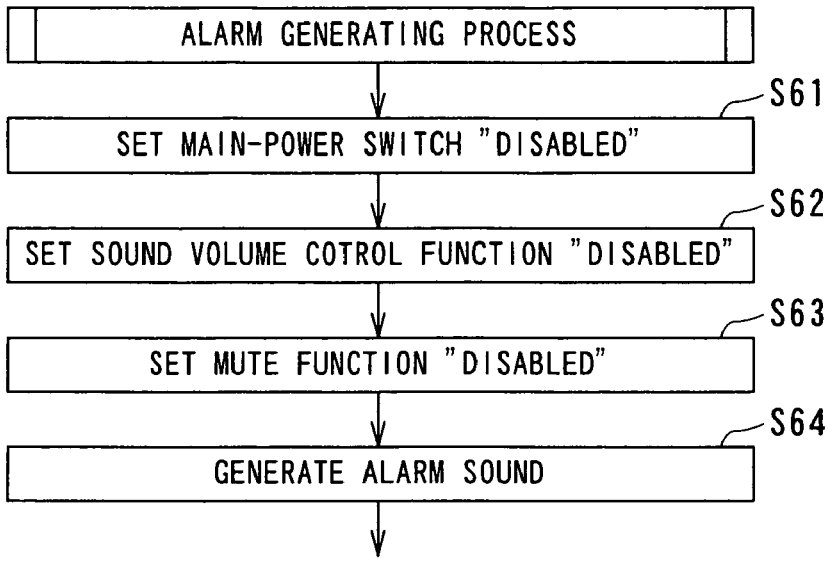
FIG. 5 is a flowchart showing in detail an alarm generating process.

FIG. 5 is a flowchart showing in detail the alarm generating process in Step S6 in the flowchart in FIG. 3.

In Step S61, the information processor 2 sets a function of turning off the main power supply by using the main-power-supply switch 7 to "disabled". When the user depresses the main-power-supply switch 7 on the information processing apparatus 1 in the power-on state, the power-supply controller 6 informs the information processor 2 of the depression of the main-power-supply switch 7.

Ordinarily, after the information processor 2 receives the notification, the information processor 2 performs the power-off process to be in the power-off state. However, if the turning on of the main power supply is caused by the detection of the movement, the information processor 2 sets the function of turning off the main power supply by using the main-power-supply switch 7 to "disabled" and maintains the power-on state, without switching to the power-off state, even when the main-power-supply switch 7 is depressed.

In this case, even if an illegal carrier intends to depress the main-power-supply switch 7 on the information processing apparatus 1 to turn off the main power supply, the main power supply cannot be turned off. Hence, the illegal carrier cannot turn off the main power supply to stop the alarm.

As described above, the information processor 2 serves as means for disabling the function of turning off the main power supply.

In Step S62, the information processor 2 sets a sound-volume control function to "disabled". Specifically, the information processor 2 switches the volume-control-function disabling switch 42 in the alarm generator 4 to the side of the bypass circuit 47. As a result, even if an illegal carrier intends to lower the volume of the alarm with the sound-volume control dial of the information processing apparatus 1, the alarm is generated at a sound volume set in the information processor 2. For example, the alarm is always generated at a maximum volume.

In Step S63, the information processor 2 sets the mute function to "disabled". In an ordinary usage, connecting the headphone or the like to the information processing apparatus 1 automatically mutes the sound from the built-in speaker 41 owing to the mute function for the user's convenience. However, if the power-on state is caused by the detection of a movement, the mute function is suppressed.

Accordingly, even if an illegal carrier connects the headphone or the like to the information processing apparatus 1, the alarm sound from the built-in speaker 41 cannot be cleared.

In Step S64, the CODEC 56 in the information processor 2 generates an alarm sound that is raised by the built-in speaker 41.

Figure 6:
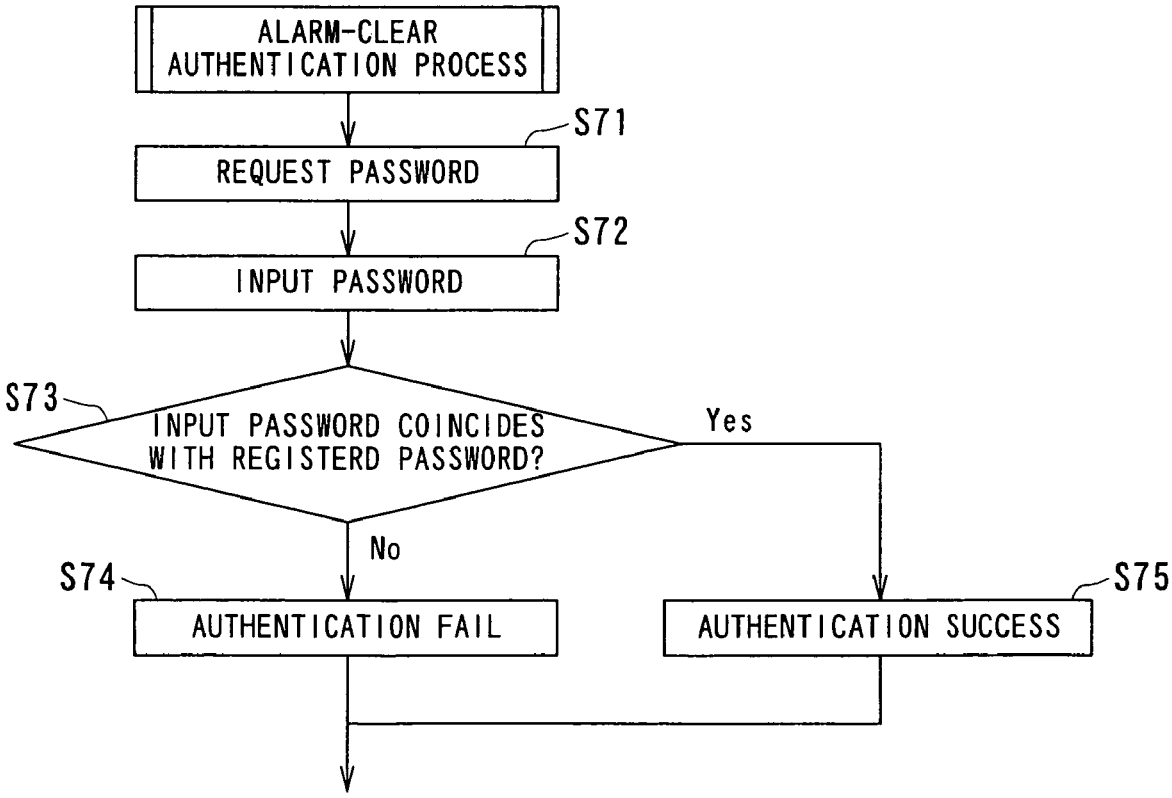
FIG. 6 is a flowchart showing in detail an authentication process.

FIG. 6 is a flowchart showing in detail the authentication process in Step S7 in FIG. 3.

In Step S71, the information processor 2 requests a password for the alarm-clear authentication process. This password is in use for authenticating the alarm clear. Using the same password as the power-on password in the alarm-clear authentication process increases the usability for the legal owner. The password is requested by using the screen of the main display 3 of the information processing apparatus 1. Using the same screen as the ordinary power-on password requesting screen, with which the legal owner is familiar, also increases the usability.

In Step S72, a password is input by using the keyboard 102 of the information processing apparatus 1, as in the input of the power-on password.

In Step S73, the information processor 2 determines whether the input password coincides with the password that has been registered in advance. If the input password coincides with the registered password, in Step S75, the information processor 2 determines that the authentication succeeds. If the input password does not coincide with the registered password, in Step S74, the information processor 2 determines that the authentication fails.

When the same password as the power-on password is used in the alarm clear, it is sufficient for the legal owner to register the power-on password and there is no need to additionally register the password for the alarm clear. In this sense, the usability for the legal owner can be increased.

Figure 7:
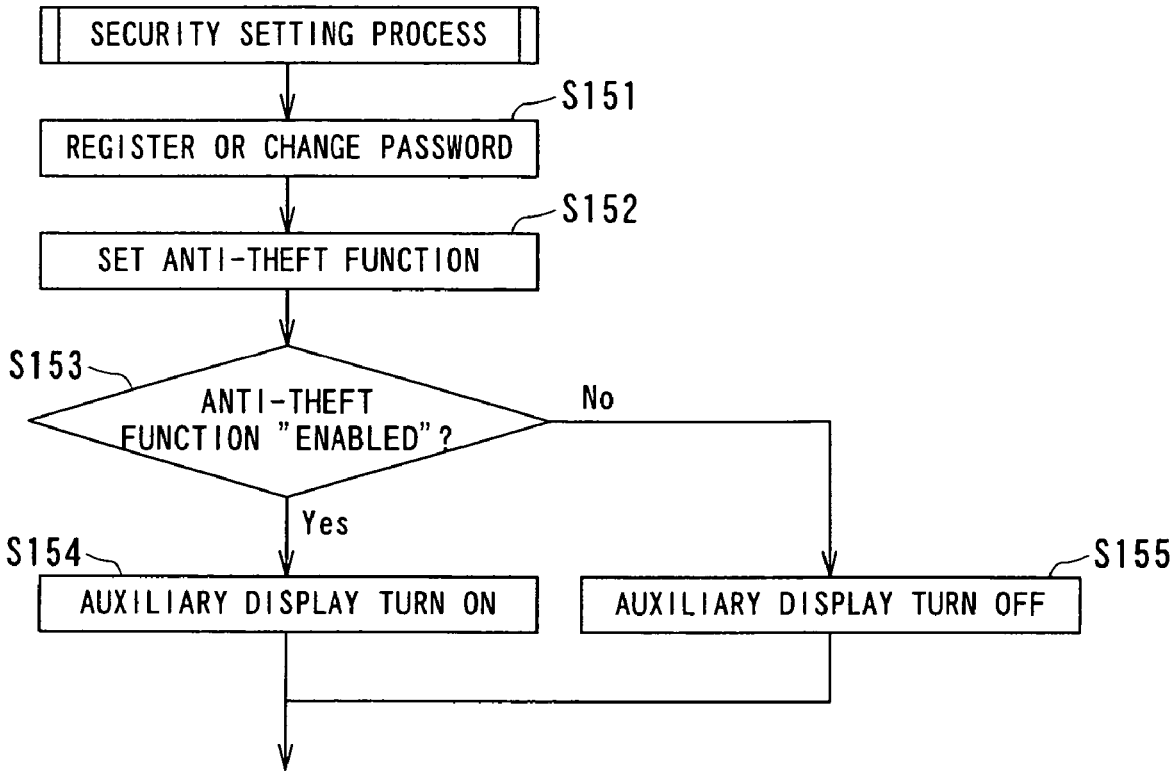
FIG. 7 is a flowchart showing in detail a security setting process.

FIG. 7 is a flowchart showing in detail the security setting process in Step S15 in FIG. 3. In the security setting process, in Step S151, a password is registered or changed. In Step S152, the antitheft function is set.

In Step S153, it is determined whether the antitheft function is set to "enabled" or "disabled". If the antitheft function is set to "enabled", in Step S154, the auxiliary display 9 (for example, a light emitting diode (LED)) on the information processing apparatus 1 is turned on. If the antitheft function is set to "disabled", in Step S155, the auxiliary display 9 is turned off.

The auxiliary display 9 is electrified even in the power-off state. The legal owner visually confirms whether the auxiliary display 9 is turned on or off to confirm the setting of the antitheft function for the information processing apparatus 1. Accordingly, it is possible to prevent the legal owner from erroneously moving the information processing apparatus 1 to generate the alarm when the antitheft function is set to "enabled".

Figure 8:
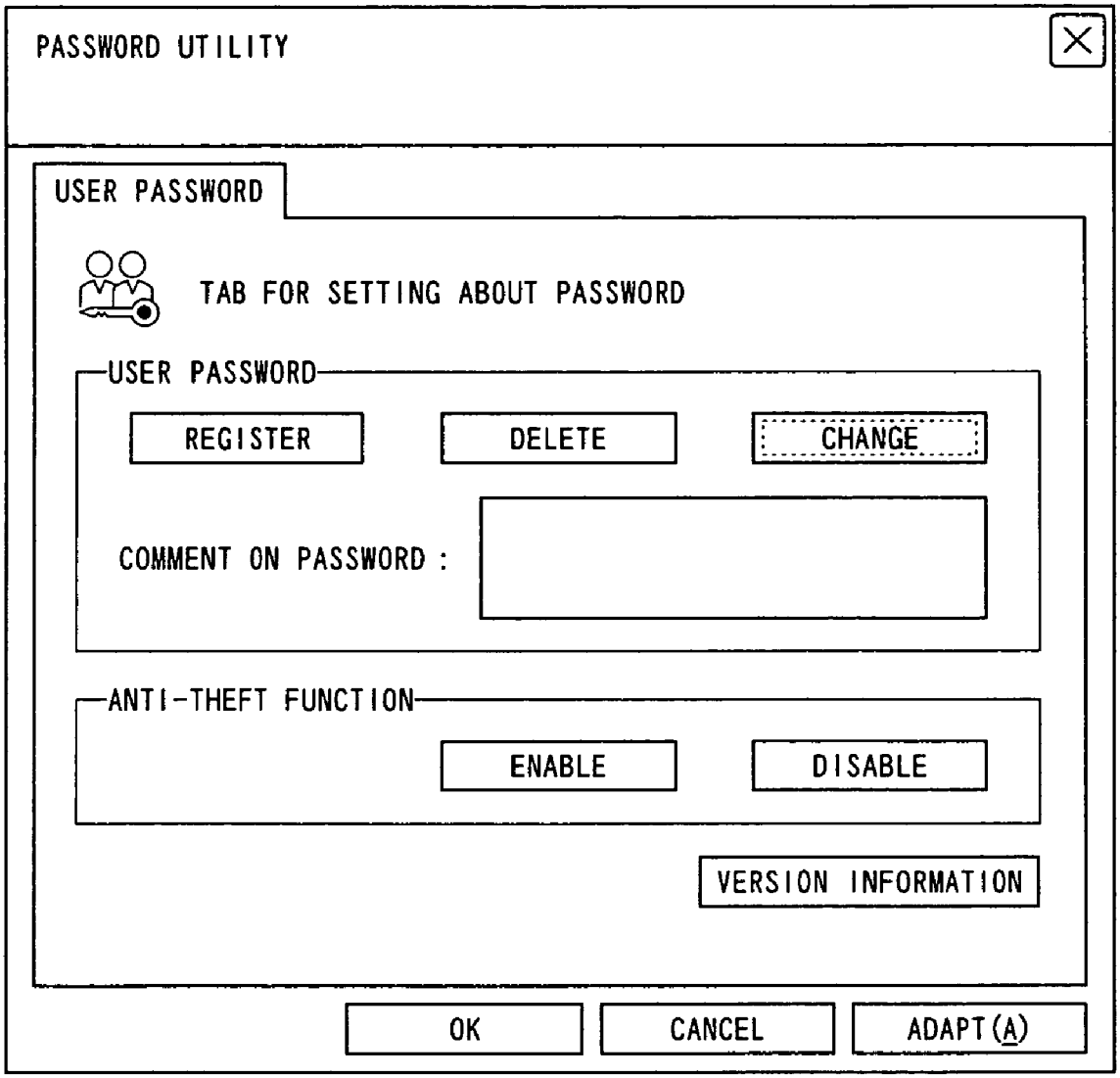
FIG. 8 shows an example of the screen displayed in a main display for setting an antitheft function.

FIG. 8 shows an example of the screen displayed in the main display 3 in the security setting process. Since the same screen can be used to perform registration or change of the password (serving both as the power-on password and the alarm-clear password) and setting of the antitheft function, as shown in FIG. 8, the setting operation relating to the security can be simplified.

Figure 9:
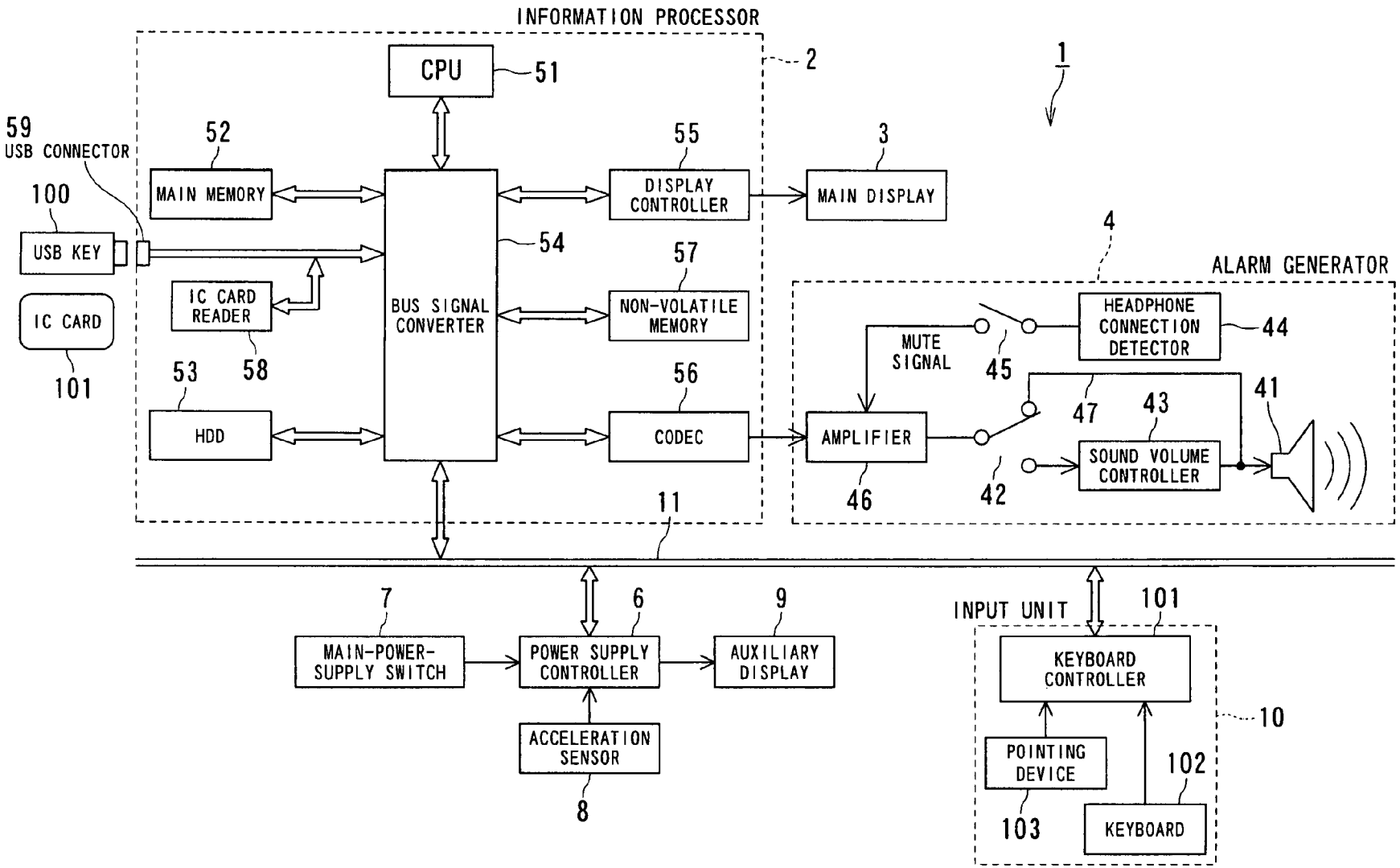
FIG. 9 is a block diagram showing an information processing apparatus according to a second embodiment of the present invention.

FIG. 9 is a block diagram showing an information processing apparatus 1 according to a second embodiment of the present invention.

The information processing apparatus 1 of the second embodiment has a USB connector 59 and an IC card reader 58 in the information processor 2, in addition to the components of the information processing apparatus 1 of the first embodiment.

The authentication method by using the password is adopted in the first embodiment, whereas so-called token authentication is adopted in the second embodiment. A USB key 100 or an IC card 101 is used in the token authentication.

Inserting the USB key 100 storing the authentication information concerning the legal owner in advance into the USB connector 59 allows the authentication to be performed. The compact and portable USB key 100 is managed only by the legal owner.

The use of the USB key 100 allows the authentication operation to be easily and rapidly performed, compared with the authentication by using the password.

The same effect can be achieved in the authentication by using the IC card 101. The thin IC card 101 made of, for example, plastic has the memory and the CPU embedded therein. Inserting the IC card 101, which stores the authentication information concerning the legal owner in its memory, into the IC card reader 58 in the information processor 2 allows the authentication to be performed.

Although both the authentication by using the USB key 100 and the authentication by using the IC card 101 are shown in FIG. 9, either one may be adopted.

Either token authentication serves as both the power-on authentication and the alarm-clear authentication.

Other authentication methods include an authentication method by using a memory card, an authentication method by using a wireless card, and biometrics authentication including fingerprint identification. Any authentication method can be adopted in the alarm-clear authentication serving as the antitheft function for the information processing apparatus 1, as long as the authentication method is adopted as the power-on authentication by the information processing apparatus 1.

Figure 10:
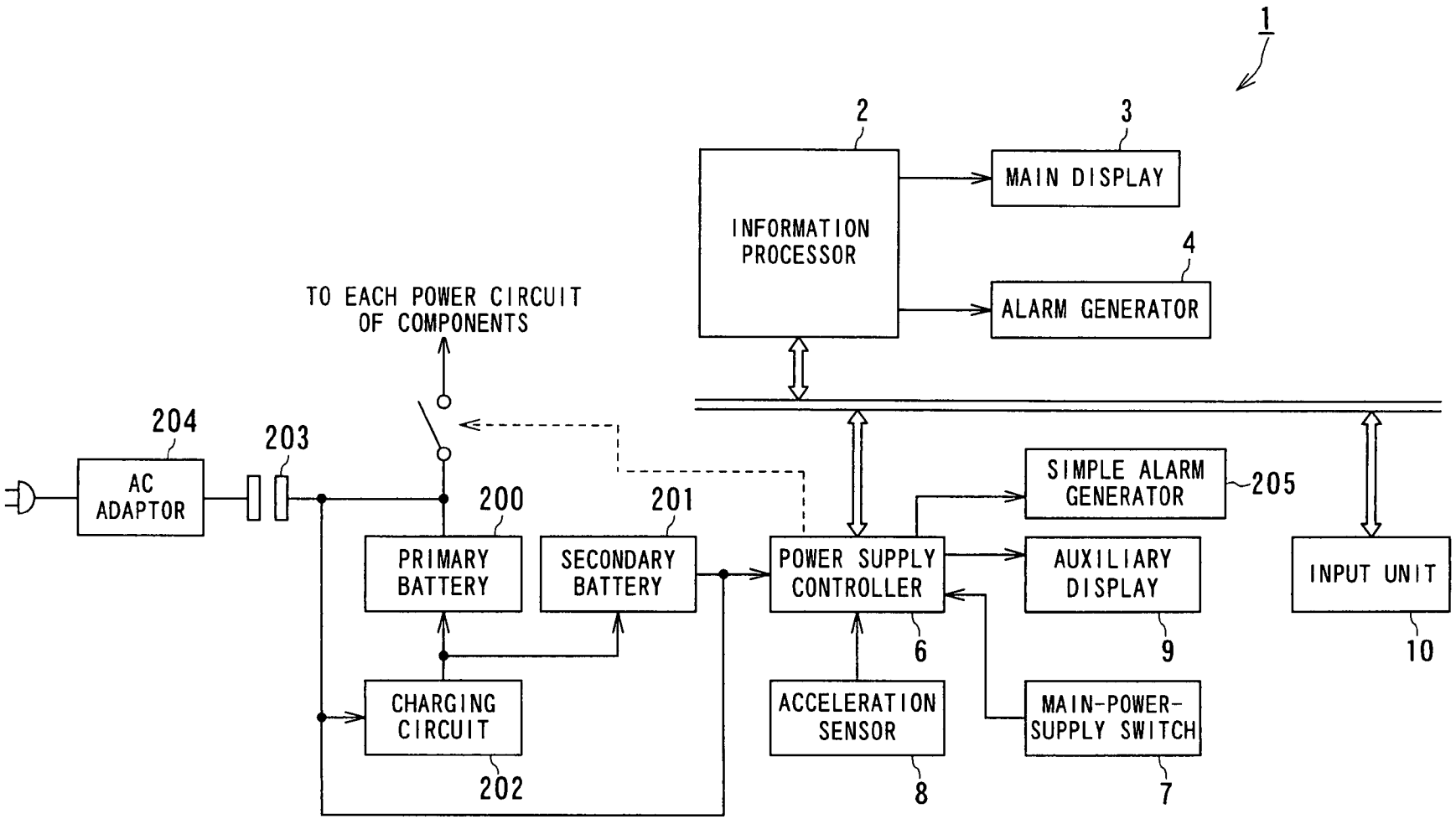
FIG. 10 is a block diagram showing an information processing apparatus according to a third embodiment of the present invention.

FIG. 10 is a block diagram showing an information processing apparatus 1 according to a third embodiment of the present invention.

A portable information processing apparatus is an example of the information processing apparatus 1 requiring the antitheft function. The portable information processing apparatus generally uses a battery as the power supply. Alternatively, the portable information processing apparatus uses a battery together with an external power supply.

The battery is removably inserted in the information processing apparatus 1. Ordinarily, the battery can be relatively easily removed from the information processing apparatus 1. Accordingly, when an illegal carrier disconnects the external power supply and removes the battery, no power is supplied to the power-supply controller 6 in the information processing apparatus 1 and, therefore, the movement cannot be detected.

The information processing apparatus 1 of the third embodiment has a primary battery 200 and a secondary battery 201 as the battery. The information processing apparatus 1 of the third embodiment also has a simple alarm generator 205 operating under the control of the power-supply controller 6. The information processing apparatus 1 is structured such that power is supplied from the secondary battery 201 to the power-supply controller 6. Since the power-supply controller 6 consumes a small amount of power, the secondary battery 201 can be reduced in size. Hence, the secondary battery 201 is fixed in the information processing apparatus 1 by using, for example, screws such that the secondary battery 201 cannot easily be removed.

With such a structure, even if an illegal carrier removes the primary battery 200 from the information processing apparatus 1, a movement can be detected with the power-supply controller 6 operating by using the power supplied from the secondary battery 201. In addition, the simple alarm generator 205 (for example, a buzzer) may generate an alarm.

Both the primary battery 200 and the secondary battery 201 can be charged in a charging circuit 202 with power externally supplied through an AC adaptor 204.

Figure 11:
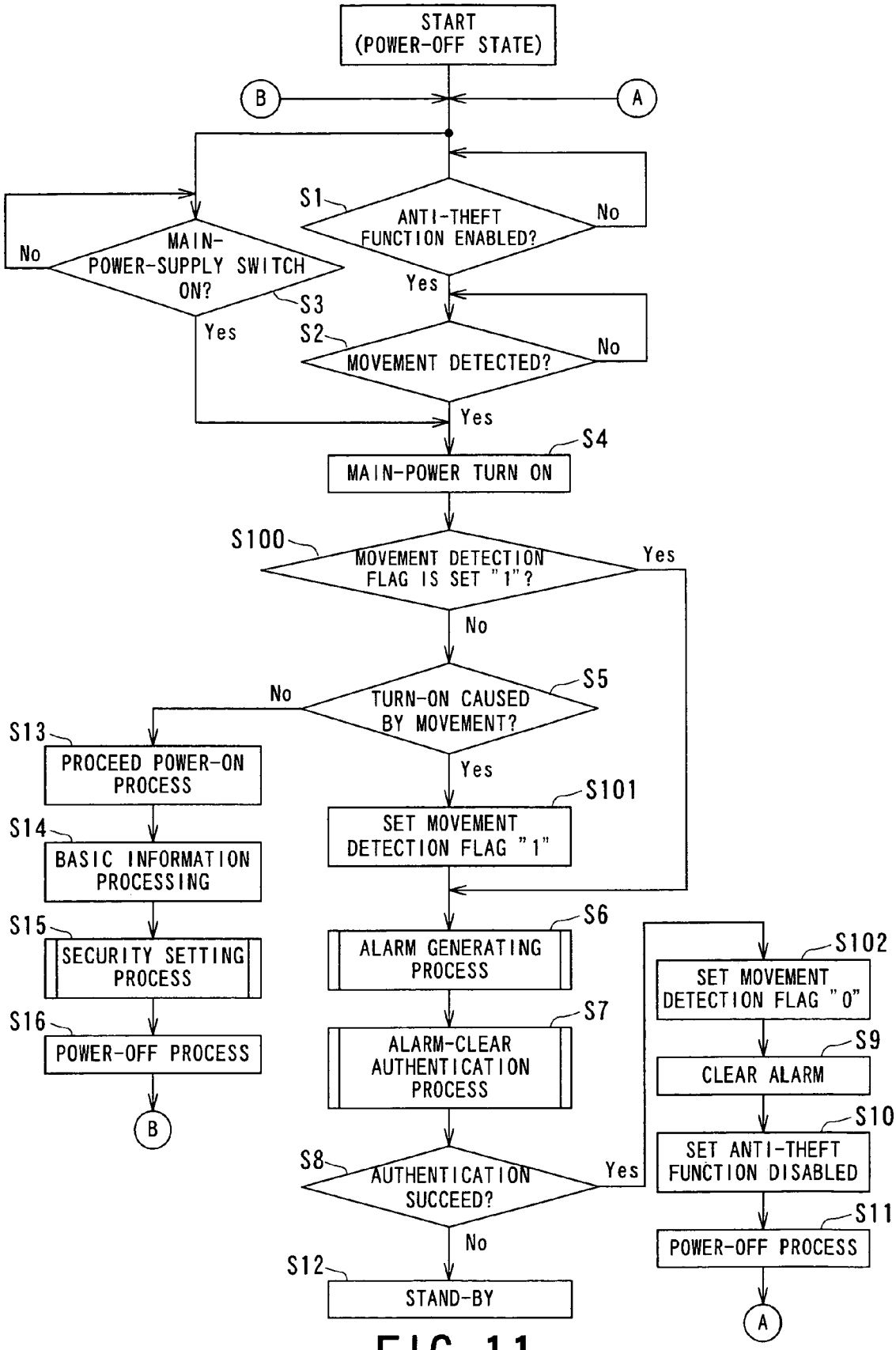
FIG. 11 is a flowchart showing the basic process of an information processing apparatus according to a fourth embodiment of the present invention.

FIG. 11 is a flowchart showing the basic process of an information processing apparatus 1 according to a fourth embodiment. The following description focuses on steps different from those in the flowchart in FIG. 3.

After the main power supply is turned on in Step S4, in Step S100, the information processor 2 determines whether a movement detection flag is set to "1" or "0" in the nonvolatile memory 57 in the information processor 2. The movement detection flag is set to "1" when the main power supply is turned on based on the detection of the movement in the previous use of the information processing apparatus 1 and the main power supply is turned off by using means other than the authentication by the legal owner. For example, when the main power supply of the information processing apparatus 1 is turned on because an illegal carrier moves the information processing apparatus 1 and, then, the illegal carrier removes the battery in order to clear the alarm to turn off the main power supply, the movement detection flag is set to "1".

If the movement detection flag is set to "1" in Step S100, the information processor 2 proceeds to Step S6 to generate an alarm.

If the movement detection flag is set to "0" in Step S100, then in Step S5, the information processor 2 determines whether the turning on of the main power supply is caused by the detection of the movement. If the information processor 2 determines that the turning on of the main power supply is caused by the detection of the movement, then in Step S101, the information processor 2 sets the movement detection flag to "1" in the nonvolatile memory 57 in the information processor 2.

In Step S6, the information processor 2 generates an alarm. If the authentication succeeds in the authentication process in Step S7, that is, if the information processor 2 determines the legal owner, then in Step S102, the information processor 2 sets the movement detection flag to "0" in the nonvolatile memory 57.

If the authentication fails in the authentication process in Step S7, the movement detection flag is maintained in "1" and the alarm continues to be generated. If an illegal carrier, for example, removes the battery in order to clear the alarm, the movement detection flag in the nonvolatile memory 57 is maintained in "1" while the alarm is cleared.

Accordingly, if the illegal carrier turns on the main power supply at another position after moving the information processing apparatus 1, an alarm is generated again based on the determination in Step S100. Hence, it is difficult for the illegal carrier to continue to use the information processing apparatus 1.

Figure 12:
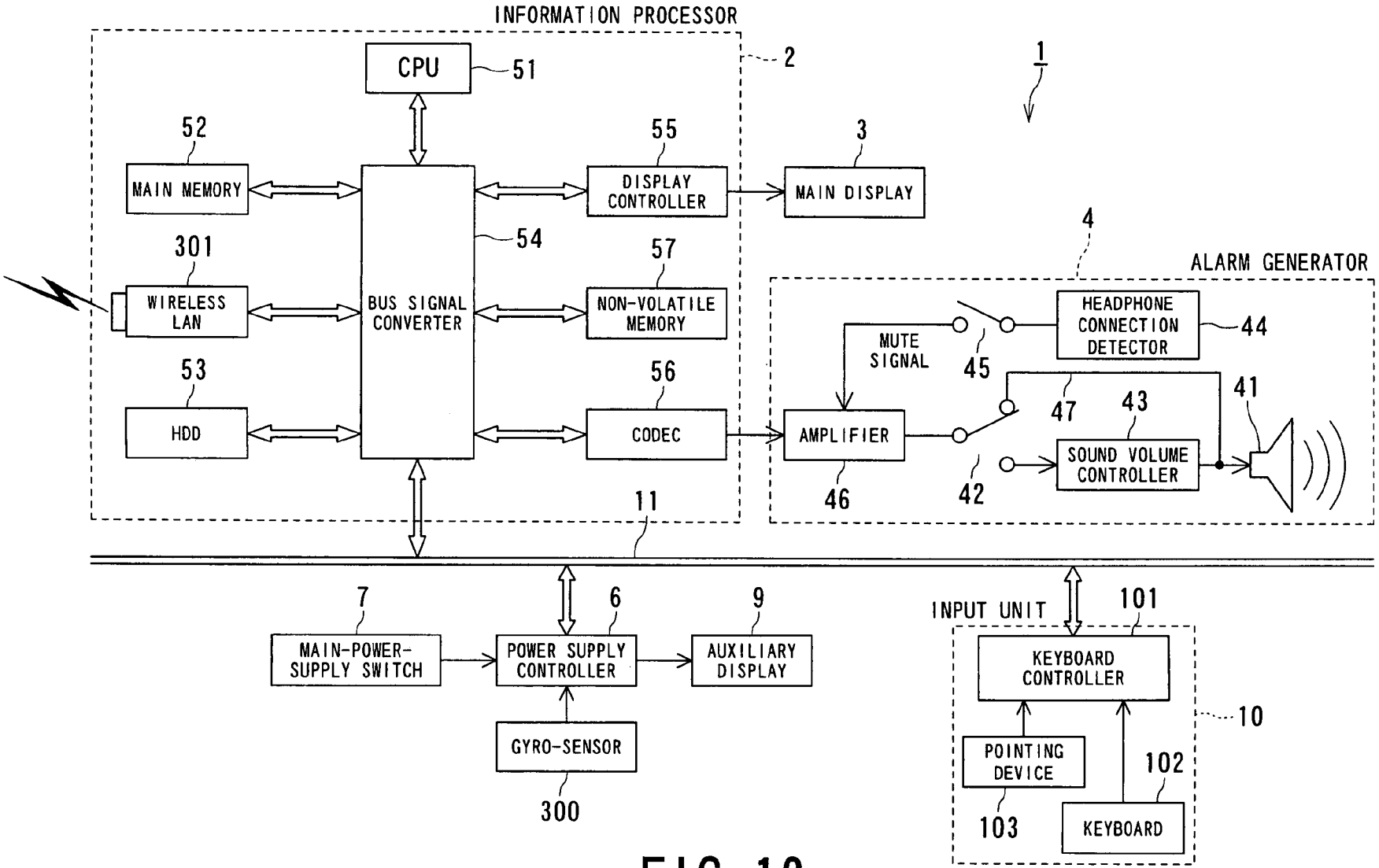
FIG. 12 is a block diagram showing an information processing apparatus according to a fifth embodiment of the present invention.

FIG. 12 is a block diagram showing an information processing apparatus 1 according to a fifth embodiment of the present invention.

The information processing apparatus 1 of the fifth embodiment has a gyro-sensor 300, in addition to the acceleration sensor 8 of the first embodiment. The information processor 2 in the information processing apparatus 1 of the fifth embodiment has a wireless local area network (LAN) 301.

The gyro-sensor 300 has a function of detecting the positional information concerning the information processing apparatus 1. According to the fifth embodiment, the power-supply controller 6 in the information processing apparatus 1 determines whether a movement is detected based on the positional information detected by the gyro-sensor 300. For example, when the information processing apparatus 1 moves to a position at a distance more than 10 m from the original position, the power-supply controller 6 determines that the movement is detected. The automatic turning on of the main power supply after the detection of the movement and the like are performed in the same manner as in the first embodiment.

If an illegal carrier carries the information processing apparatus 1, the information processing apparatus 1 maintains the power-on state and the function of turning off the main power supply is disabled. At this time, the wireless LAN 301 in the information processor 2 is activated.

Accordingly, the positional information concerning the information processing apparatus 1 detected by the gyro-sensor 300 can be transmitted through the wireless LAN 301.

With this function, the position of the information processing apparatus 1 carried by the illegal carrier can be determined.

As described above, according to the present invention, it is possible to utilize the function supported by the information processing apparatus 1 by automatically turning on the main power supply of the information processing apparatus 1 in response to the detection of a movement. The information processing apparatus 1 of the present invention provides the effective antitheft function against an illegal carrier and provides the usable information processing apparatus 1 for the legal owner.

It is to be understood that the present invention is not limited to the above embodiments but modifications will be apparent to those skilled in the art without departing from the sprit of the present invention. Appropriate combinations of the components disclosed in the above embodiments can realize various aspects. For example, some components may be deleted from all the components in any of the embodiment. Alternatively, the components in different embodiments may be appropriately combined.

What is claimed is:

1. An information processing apparatus comprising:

a body;

an input unit for inputting information;

a movement detecting sensor, provided in the body, to detect a movement of the body;

a power-supply controller to turn on a main power supply in the body in response to a movement detection signal supplied from the movement detecting sensor;

an alarm generator to generate an alarm when the main power supply is turned on in response to the movement detection signal; and a disabling unit to disable a function of the information processing apparatus when the main power supply is turned on in response to the movement detection signal supplied from the movement detecting sensor, wherein the disabling unit includes at least one of:

(i) a unit to disable a function of turning off the main power supply;

(ii) a unit to disable a volume control function of the alarm generator; and (iii) a unit to disable a mute function of the alarm generator.

2. The information processing apparatus according to claim 1, wherein the movement detecting sensor is an acceleration sensor, and wherein the alarm generator is a speaker.

3. The information processing apparatus according to claim 1, wherein the information processor includes an alarm-clear authentication unit for clearing the alarm when alarm-clear authentication information registered in advance coincides with alarm-clear authentication information input with the input unit.

4. The information processing apparatus according to claim 3, wherein the information processor includes a power-on authentication unit for performing a startup sequence when authentication information input with the input unit on startup coincides with authentication information registered in advance in the information processor.

5. The information processing apparatus according to claim 3, wherein the alarm-clear authentication unit clears the alarm when an alarm-clear password input with the input unit coincides with an alarm-clear password registered in advance in the information processor.

6. The information processing apparatus according to claim 5, wherein the information processor includes a power-on-password authentication unit for performing a startup sequence when a password input with the input unit on startup coincides with a password stored in advance in the power-supply controller.

7. The information processing apparatus according to claim 1, further comprising a setting unit for enabling or disabling in advance an alarm generating function of the alarm generator.

8. The information processing apparatus according to claim 7, further comprising an auxiliary display capable of displaying the setting in the setting unit.

9. The information processing apparatus according to claim 1, wherein the main body is capable of being driven by a battery or an external power supply and includes a secondary battery for supplying power to the power-supply controller.

10. The information processing apparatus according to claim 1, wherein the main body includes a nonvolatile memory for storing information indicating that the main body is moved when the turning on of the main power supply is caused by the movement detection signal supplied from the movement detecting sensor, and wherein the main body enables an alarm generating function of the alarm generator when the information stored in the nonvolatile memory indicates that the main body is moved, and disables the alarm generating function of the alarm generator when the information indicating that the main body is moved is not stored in the nonvolatile memory.

11. The information processing apparatus according to claim 1, wherein the movement detecting sensor is a gyro-sensor capable of detecting positional information concerning the main body.

12. The information processing apparatus according to claim 11, wherein the main body includes a wireless communication unit and transmits the positional information detected by the gyro-sensor with the wireless communication unit.

13. An antitheft method for an information processing apparatus, the method comprising:

detecting a movement of the information processing apparatus by using a movement detecting sensor;

outputting a movement detection signal when the movement detecting sensor detects the movement of the information processing apparatus;

turning on a main power supply of the information processing apparatus in response to the movement detection signal supplied from the movement detecting sensor;

generating an alarm when the turning on of the main power supply is caused by the movement detection signal; and disabling a function of turning off the main power supply and a volume control function of a speaker of the information processing apparatus, when the turning on of the main power supply is caused by the movement detection signal.

14. The antitheft method for the information processing apparatus according to claim 13, wherein the information processing apparatus includes an input unit for inputting information, and wherein the information processing apparatus clears the alarm when a password registered in advance in an information processor in the information processing apparatus coincides with a password input with the input unit.

* * * * *